US005566953A

United States Patent [19]

Arriola et al.

[11] Patent Number: 5,566,953

[45] Date of Patent: Oct. 22, 1996

[54] GAME FOOTBAG WITH LOW REBOUND CHARACTERISTICS

[75] Inventors: Martin F. Arriola, Torrance; Daniel M. Roddick, Pasadena, both of Calif.

[73] Assignee: Mattel, Inc., El Segundo, Calif.

[21] Appl. No.: 515,278

[22] Filed: Aug. 15, 1995

[51] Int. Cl.[6] ..... A63B 43/00

[52] U.S. Cl. ..... 273/115; 273/58 F

[58] Field of Search ..... 273/415, 428, 273/58 F

[56] References Cited

U.S. PATENT DOCUMENTS

| | | | |
|---|---|---|---|
| D. 55,413 | 6/1920 | Cigol . | |
| D. 232,957 | 9/1974 | Kahelin . | |
| D. 281,521 | 11/1985 | Stalberger, Jr. et al. . | |
| D. 292,014 | 9/1987 | Stalberger, Jr. et al. . | |
| 646,350 | 3/1900 | Breinl . | |
| 676,506 | 6/1901 | Knight et al. . | |
| 3,480,280 | 11/1969 | Gamertsfelder | 273/415 |
| 3,518,786 | 7/1970 | Holtvoigt . | |
| 3,924,856 | 12/1975 | Dekan et al. | 273/415 |
| 3,937,470 | 2/1976 | Stalberger, Jr. et al. . | |
| 4,011,611 | 3/1977 | Lederman . | |
| 4,106,769 | 8/1978 | Manska . | |
| 4,131,276 | 12/1978 | Judkins . | |
| 4,151,994 | 5/1979 | Stalberger, Jr. . | |
| 4,238,537 | 12/1980 | Kerr . | |
| 4,248,424 | 2/1981 | Judkins . | |
| 4,354,679 | 10/1982 | Steinmetz . | |
| 4,522,396 | 6/1985 | Girard et al. . | |
| 4,643,424 | 2/1987 | Nakajima . | |
| 4,717,158 | 1/1988 | Pennisi . | |
| 4,943,066 | 7/1990 | Lathim et al. . | |
| 4,974,844 | 12/1990 | Richards . | |
| 5,066,018 | 11/1991 | Hinton | 273/415 X |
| 5,328,191 | 7/1994 | Taylor, Jr. . | |

*Primary Examiner*—Paul E. Shapiro

*Attorney, Agent, or Firm*—Kolisch, Hartwell, Dickinson, McCormack & Heuser

[57] ABSTRACT

A low-rebound, impact-deformable footbag includes plural panels having peripheral edges which are connected together to define an impact-deformable, semi-collapsible chamber which permits the footbag to assume an arbitrarily-changing, random shape in response to an externally-applied deformation force, such as kicking. The footbag includes at least one panel, a portion of which is formed from an apertured material for providing a view internally of the chamber. Plural lightweight, impact-damping filler members are disposed in the chamber, some of which being viewable through the apertured material. Such filler members are positioned within the chamber for interacting with other such filler members for damping such applied deformation force.

19 Claims, 2 Drawing Sheets

GAME FOOTBAG WITH LOW REBOUND CHARACTERISTICS

BACKGROUND AND SUMMARY

This invention relates generally to amusement and sports devices, and more particularly it concerns a game footbag which is kickable by one or more players for keeping the footbag aloft for a period of time.

Game footbags for use by one or more players are known. Such footbags are useful in recreational or sports settings in which one or more players desire to kick the footbag and keep it aloft for a period of time. Additionally, such footbags are useful for teaching eye-to-foot coordination. For example, U.S. Pat. No. 4,151,994 to Stalberger, Jr. discloses a footbag having a nearly spherical shape formed from two dogbone-shaped cover pieces which are stitched together about their peripheries and filled with a filler material which includes a plurality of pellets.

Such conventionally-available footbags have been found to be difficult to master by a beginning player because of a number of reasons. First, such footbags are generally small, having diameters of around 1.5–to 2–inches. Such a small target is difficult for a beginning player to contact. Second, such conventionally-available footbags are generally filled with hardened pellets which cause such footbags to greatly rebound into the air when kicked. This increases the potential distance a footbag may travel, and in turn, subsequently increases the chances that a new player will not be able to get to a falling footbag in time to relaunch the same into the air.

A significant need exists for a footbag which may be practiced with by a beginning player so that the player will be able to learn and master fundamental kicking and playing techniques which are necessary for playing with smaller, more conventional footbags.

With the above problems in mind, it is a general object of the present invention to provide a footbag which may be used by a beginning player for learning playing techniques which would otherwise be more difficult to learn with conventional footbags.

It is another object of the present invention to provide a footbag which is dimensioned for enhanced aerodynamic characteristics which are most suitable for beginning players.

It is yet another object of the invention to provide a footbag which is more controllable by a player.

It is a further object of the present invention to provide a footbag which is inexpensive to manufacture, yet durable enough to withstand the uses to which it will be put.

The invention achieves these and other objects in the form of a low-rebound, impact-deformable footbag which includes plural panels having peripheral edges which are connected together, and when so connected define an impact-deformable, semi-collapsible chamber which permits the footbag to assume an arbitrarily-changing, random shape in response to an externally-applied deformation force, such as kicking, kneeing and the like. The footbag includes at least one panel, a portion of which is formed from an apertured material for providing a view internally of the chamber. Plural lightweight, impact-damping filler members are disposed in the chamber, some of which are viewable through the apertured material. Such filler members are positioned within the chamber for interacting with other such filler members for damping such applied deformation force.

These and additional objects and advantages of the present invention will be more readily understood after a consideration of the drawings and the detailed description of the preferred embodiment.

DETAILED DESCRIPTION OF THE PREFERRED EMBODIMENT

Figure 1:
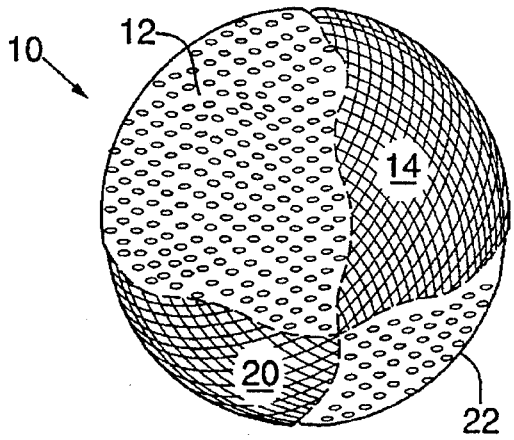
FIG. 1 is a slightly-reduced side elevation of a footbag according to the preferred embodiment of the invention.
Figure 2:
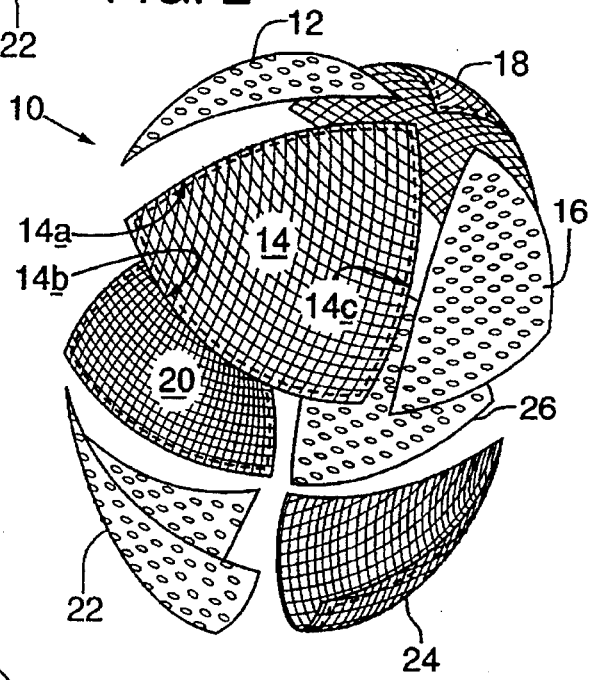
FIG. 2 is an exploded view of a plurality of panels defining the footbag of FIG. 1.
Figure 3:
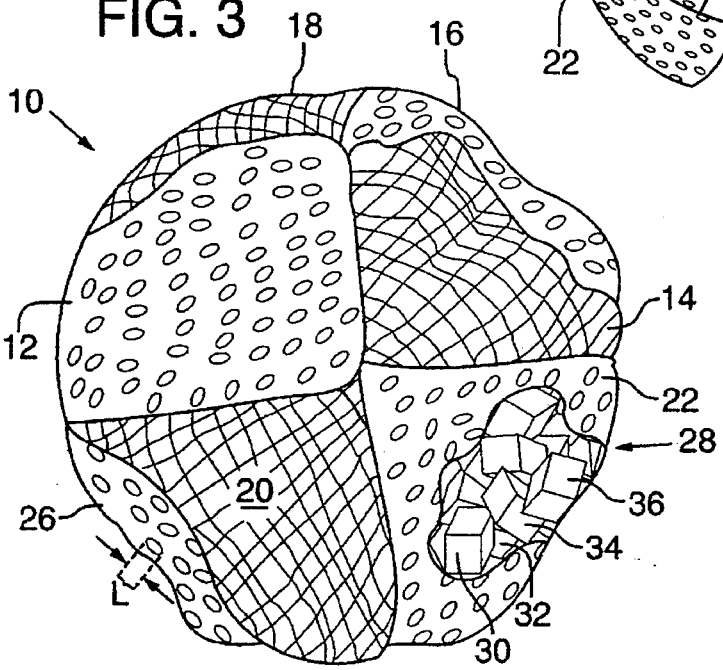
FIG. 3 is a side elevation of the footbag of FIG. 1 which is slightly enlarged and which has a portion broken away to show detail.

As shown in FIGS. 1 through 3, a low-rebound, impact-deformable footbag according to the present invention is generally indicated at 10.

The footbag 10 includes a plurality of panels 12 through 26 which are most easily seen in FIG. 2 where the footbag is shown in an exploded view. Panels 14, 18, 20 and 24 may be, and preferably are, formed from a nylon rip-resistant, non-apertured material. Panels 12, 16, 22 and 26 may be, and preferably are, formed from an apertured material known as polyester mesh which is both durable and resists tearing. The panels collectively define a cover of yieldable material, each individual panel having a so-called bowed or arcuate construction such that when the panels are connected or joined together, as described below, they define a generally semi-collapsible, impact-deformable chamber which is partially filled with a plurality of lightweight filler members.

Each of panels 12 through 26 includes a peripheral edge which is connected, preferably by stitching, to a peripheral edge of an adjacent panel. Preferably, adjacent panels are formed from different materials so that footbag 10 has the apertured/non-apertured panel orientation shown. Put another way, each of the non-apertured panels 14, 18, 20 and 24 is bordered by at least three apertured panels for a purpose which will become evident below. It will be appreciated, however, that any suitable orientation will suffice.

One of the peripheral edges is indicated for panel 14 in FIG. 2 at 14*a*, 14*b* and 14*c*. Each of the peripheral edges of each of the respective panels is connected to an adjacent panel for defining the chamber mentioned above. It will be appreciated that because panels 12 through 26 are formed from a yieldable material, the footbag is capable of being placed in an uncollapsed state (such as when it is not being kicked). In such uncollapsed state, the chamber collectively defined by the panels may be said to be generally spherical.

Each of panels 14, 18, 20 and 24 in FIG. 2 have indicated thereon adjacent each's peripheral edge, a dashed seam line which follows, generally, the shape of the edge. It will be appreciated that the material between the seam line and the edge is necessary so that the panels may be sewn together.

FIG. 3 shows footbag 10 in an intermediate state of collapse where each of apertured panels 12, 16, 22 and 26 may be seen to be connected to non-apertured panels 14, 18 and 20, respectively. Panel 24 is not specifically shown in FIG. 3 because of the orientation of footbag 10.

A portion of panel 22 has been broken away to expose the chamber defined by the panels, and a plurality of resilient filler members, indicated generally at 28, may be seen to be disposed therein. Filler members 28 include a number of polygonally-shaped individual members such as those indicated at 30, 32, 34 and 36. Preferably, the filler members are generally square-shaped and dimensioned so that they will not pass through any of the apertures in any of the apertured panels. To that end, in the preferred embodiment, each aperture is generally oval-shaped and about 0.125 of an inch in longitudinal length, such length being generally indicated at L in FIG. 3, and about half that in width; and, each square-shaped filler member includes sides which are no longer than about 0.25 of an inch so that it is quite difficult, if not impossible, for a filler member to pass through an aperture.

Figure 4:
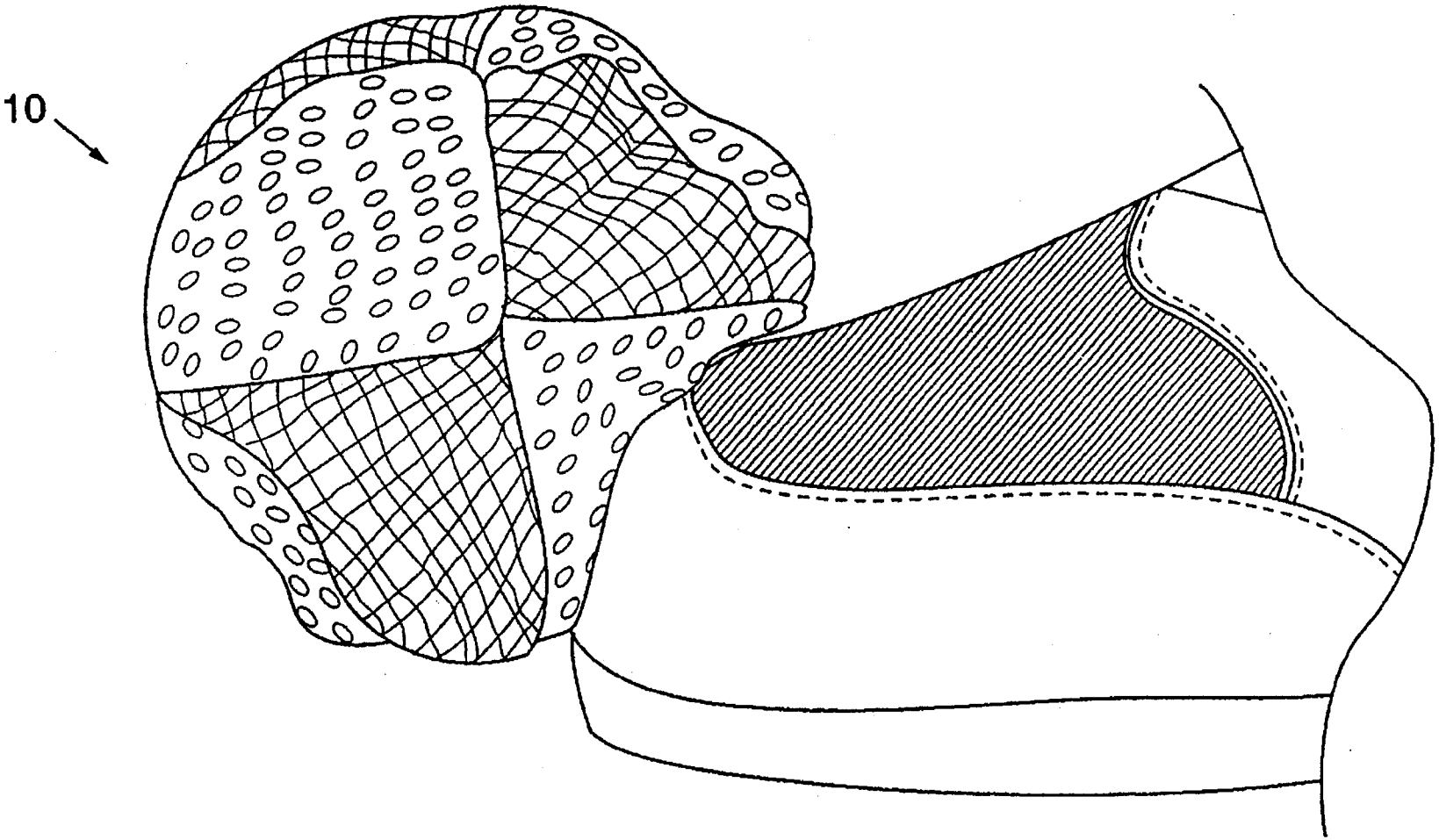
FIG. 4 shows a footbag according to the preferred embodiment undergoing an externally-applied deformation force.

Preferably, filler members 28 are formed from a lightweight, generally resilient, impact-damping material which, upon the application of an externally-applied deformation force, such as a kicking force indicated in FIG. 4, the filler members dampen the force and reduce the tendency of the footbag to rebound in the direction of the external force. Put another way, filler members 28 interact with another upon the application of an externally-applied deformation force to dampen or reduce the rebounding of the footbag. A material which has been found preferable is a lightweight, ethylene-vinyl-acetate (EVA) foam material. Such material is desirable, not only for its light weight, but for its ability to dampen the externally-applied force mentioned above. Additionally, EVA foam has been found to be easily dyed so that the filler members may be dyed any desired color.

Turning now to a discussion of some relevant dimensions, it will be appreciated that because footbag 10 is intended for use by individuals who are learning to kick and play with footbags, it is generally larger than conventionally-available footbags which are generally around 2 inches in diameter. Moreover, because such conventionally-available footbags are generally substantially filled with hardened pellets which impart high rebound characteristics to such footbags more suited for advanced players, the dimensions, material, quantity, and shape of the filler members of the present footbag have been adapted to accommodate individuals who are new to kicking footbags. In addition, as described below, the cover of footbag 10 has been adapted so that the footbag effectively floats or hangs in the air when it is kicked.

The preferred embodiment of the present invention is formed from eight panels of lightweight, yieldable material. Each of the panels is connected to three other panels which are formed from a different type of material. Four of the panels, i.e., panels 14, 18, 20, and. 24 are formed from a non-apertured, rip-resistant nylon, while four of the panels, i.e., 12, 16, 22, and 26 are formed from an apertured, polyester mesh. It will be appreciated that the apertured panels are positioned alternatively with respect to the non-apertured panels so that when footbag 10 is kicked into the air, the plurality of apertures located thereon allow air to enter into, and effectively circulate within the chamber in which filler members 28 are disposed. This not only allows for the overall drag of the footbag to be increased, but it enhances the intermingling and interaction between the filler members, both of which, in turn, impart desirable aerodynamic characteristics which are unavailable in conventional footbags. Such characteristics include a reduced rebound potential and enhanced floatability. That is, the footbag does not rebound as high when it is kicked, and tends to remain in the air longer than would a conventional footbag which is kicked the same distance into the air.

It will be appreciated that although footbag 10 is generally semi-collapsible, it is capable of being placed in a somewhat uncollapsed state, as mentioned above, which may be characterized as generally spherical, such as is shown in FIG. 1. When the footbag is in such uncollapsed state, the chamber defined by panels 12 through 26 has a diameter in the range of around between 2–to 4–inches. This in turn, gives the footbag an uncollapsed volume in the range of around between 4–to 40– cubic inches, although preferably, the footbag's diameter is around 3.5 inches giving the same an uncollapsed volume of around 23 cubic inches.

Filler members 28, formed from the EVA foam material mentioned above, have been found to have a suitable volumetric concentration of around between 15– to 40– percent of the uncollapsed volume of the footbag, the preferred volumetric concentration being closer to 25 percent of the uncollapsed volume of the footbag. Thus, a footbag with a diameter of around 3.5 inches should be occupied by filler members having a volumetric concentration of around 4.8 or 4.9 cubic inches. Given that the filler members in the preferred embodiment are generally square-shaped, and given that the side of each square-shaped filler member measures around 0.25 of an inch, a total number of filler members of around 300 has been found suitable for providing a volumetric concentration of around 4.8 or 4.9 cubic inches.

To make footbag 10, eight triangularly-shaped panels, four being formed of the apertured material, and four being formed from the non-apertured material described above, should be cut so that the edges of each triangle measure around 2.5– to 3– inches when the panels are sewn together. It will be appreciated that because the panels need to be sewn together, extra material should be allowed for the seam area which lies between the dashed lines and the peripheral edge of each panel, as best shown on panel 14 in FIG. 2. Each panel is sewn to an adjacent panel, and once all but the last of the panels are in place, filler members 28 (FIG. 3) may be added in the concentration described above, which incidently, results in a filler member mass of around 11– to 12– grams. The final panel may now be sewn into place and the footbag readied for play. When fully assembled, the footbag has a total mass of around 15 grams.

IN OPERATION

The footbag described above provides a low-rebound, impact deformable footbag which is generally larger than conventionally-available footbags. The positioning of the apertured panels, e.g. panels 12, 16, 22 and 26, provides for air flow through the chamber in which filler members 28 (FIG. 3) are disposed, which increases the drag of the footbag for subsequently reducing the velocity with which the footbag travels through the air when it is subjected to an externally-applied deformation force such as that shown in FIG. 4. The air flow through the chamber also causes the filler members to interact with one another which also affects the aerodynamics of the footbag described above.

Thus, an individual need only kick footbag 10 into the air to experience a footbag with a more controlled, restricted flight characteristic which greatly assists the individual in learning how to properly kick a footbag. Once an individual has mastered control of the footbag of the present invention, they may graduate to more conventional footbags which are smaller, fly further, sail higher and are generally more difficult to kick than the present footbag.

Although the preferred embodiment of footbag 10 includes eight generally triangular panels, it will be understood that the footbag may be formed from any number of suitable panels which may be shaped in any suitable manner.

Briefly summarizing, a deformable footbag has been described which includes a cover constructed from a yieldable material defining a chamber. The cover includes at least one region in the form of a panel formed from a mesh material having a plurality of apertures therein for providing a view internally of the chamber. A plurality of resilient, impact-damping members are disposed within the chamber and interact with one another upon the application of an externally-applied deformation force, to dampen the force and reduce the tendency of the footbag to rebound in the direction of the external force.

While the present invention has been shown and described with reference to the foregoing preferred embodiment, it is to be understood by those of skill in the art that other changes in form and detail may be made without departing from the spirit and scope of the invention as defined in the appended claims.

We claim:

1. A low-rebound, impact-deformable footbag comprising:

a plurality of panels, each of which includes a peripheral edge which is connected to a peripheral edge of at least one adjacent panel for defining a generally impact-deformable, semi-collapsible chamber, wherein such collapsibility permits an arbitrarily-changing, random footbag shape in response to an applied deformation force, and further wherein at least a portion of one of the panels is formed from an apertured material for providing a view internally of the chamber; and a plurality of lightweight, impact-damping filler members disposed in the chamber, some of which are viewable through the apertured material, and all of which are positioned within the chamber for interacting with other such filler members for damping such applied deformation force.

2. The footbag of claim 1, wherein each panel is generally triangularly-shaped.

3. The footbag of claim 2, wherein each panel is formed from a material which is different from the material from which at least one adjacently-connected panel is formed.

4. The footbag of claim 3, wherein at least one of the panels is formed from a non-apertured material.

5. The footbag of claim 4, wherein the non-apertured material includes nylon.

6. The footbag of claim 5, wherein the footbag includes eight generally-triangular panels connected together to define the chamber, and wherein any one panel which is formed from a non-apertured material is bordered at its peripheral edge by at least three panels formed from an apertured material.

7. A deformable footbag comprising:

a cover constructed from a yieldable material defining a chamber, wherein the cover includes at least one region formed from a mesh material having a plurality of apertures for providing a view internally of the chamber; and a plurality of resilient, impact-damping members disposed within the chamber for interacting with one another upon the application of an externally-applied deformation force to dampen the force and reduce the tendency of the footbag to rebound in the direction of the external force.

8. The footbag of claim 7, wherein the impact-damping members are generally polygonally-shaped.

9. The footbag of claim 8, wherein the impact-damping members are dimensioned larger than the apertures in the cover so that the members will be retained within the chamber.

10. The footbag of claim 8, wherein the impact-damping members are generally square-shaped.

11. The footbag of claim 10, wherein the impact-damping members are formed from a lightweight foam material.

12. The footbag of claim 11, wherein the foam material includes ethylene-vinyl-acetate (EVA) foam.

13. The footbag of claim 10, wherein each side of an impact-damping member is no longer than about 0.25 of an inch.

14. The footbag of claim 13, wherein the apertures in the cover are generally oval-shaped and about 0.125 of an inch in longitudinal length.

15. The footbag of claim 7, wherein the cover defines a semi-collapsible, impact-deformable chamber, which, when not in a collapsed state is capable of defining a generally spherically-shaped chamber having a diameter no greater than about four inches.

16. The footbag of claim 15, wherein when the chamber is in a generally uncollapsed state, the chamber has a volume in the range of around four to forty cubic inches.

17. The footbag of claim 16, wherein the total volume of the impact damping members is in a range of around 15 percent to 40 percent of the volume of the chamber when the same is in a generally uncollapsed state.

18. The footbag of claim 7, wherein the total mass of the impact-damping members is around 11 to 12 grams.

19. The footbag of claim 18, wherein the total mass of the footbag is around 15 grams.

* * * * *